US009903176B2

(12) United States Patent
Gandikota et al.

(10) Patent No.: US 9,903,176 B2
(45) Date of Patent: Feb. 27, 2018

(54) EXPANDABLE PACKER

(71) Applicant: Weatherford Technology Holdings, LLC, Houston, TX (US)

(72) Inventors: Varadaraju Gandikota, Cypress, TX (US); Lev Ring, Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 407 days.

(21) Appl. No.: 14/622,012

(22) Filed: Feb. 13, 2015

(65) Prior Publication Data

US 2015/0159464 A1 Jun. 11, 2015

Related U.S. Application Data

(63) Continuation of application No. 13/942,456, filed on Jul. 15, 2013, now Pat. No. 8,967,281, which is a continuation of application No. 13/523,656, filed on Jun. 14, 2012, now Pat. No. 8,499,844, which is a continuation of application No. 12/389,090, filed on Feb. 19, 2009, now Pat. No. 8,201,636.

(60) Provisional application No. 61/029,634, filed on Feb. 19, 2008.

(51) Int. Cl.

| | |
|---|---|
| ***E21B 33/127*** | (2006.01) |
| ***E21B 43/10*** | (2006.01) |
| ***E21B 23/06*** | (2006.01) |
| ***E21B 33/12*** | (2006.01) |
| ***E21B 33/128*** | (2006.01) |

(52) U.S. Cl.

CPC ..... *E21B 33/127* (2013.01); *E21B 23/06* (2013.01); *E21B 33/1208* (2013.01); *E21B 33/128* (2013.01); *E21B 43/103* (2013.01)

(58) Field of Classification Search

CPC ..... E21B 33/127; E21B 23/06; E21B 33/128; E21B 33/1208; E21B 43/103

See application file for complete search history.

(56) References Cited

U.S. PATENT DOCUMENTS

| | | | |
|---|---|---|---|
| 2,748,463 | A | 6/1956 | Mueller |
| 2,812,025 | A | 11/1957 | Teague et al. |
| 2,890,724 | A | 6/1959 | Kennedy, Jr. |
| 3,138,761 | A | 6/1964 | Matteo |
| 3,162,245 | A | 12/1964 | Howard et al. |
| 3,358,760 | A | 12/1967 | Blagg |
| 3,385,367 | A | 5/1968 | Kollsman |
| 3,412,565 | A | 11/1968 | Lindsey et al. |

(Continued)

FOREIGN PATENT DOCUMENTS

| | | | |
|---|---|---|---|
| GB | 2426993 | A | 12/2006 |
| JP | 57058931 | A | 4/1982 |
| WO | 2004/007892 | A3 | 1/2004 |

OTHER PUBLICATIONS

Australian Office Action for Patent Application No. 2009215521, dated Jul. 15, 2011.

(Continued)

*Primary Examiner* — Blake E Michener

(74) *Attorney, Agent, or Firm* — Patterson + Sheridan, LLP

(57) ABSTRACT

Methods and apparatus include tubing expanded to create a seal in an annulus surrounding the tubing. The tubing includes a sealing material selected to cause forming of undulations in a diameter of the tubing upon expansion of the tubing. Various factors of the sealing material such as deviations in its thickness influence sealing performance of the tubing with the sealing material.

20 Claims, 13 Drawing Sheets

(56) References Cited

U.S. PATENT DOCUMENTS

| | | | |
|---|---|---|---|
| 3,432,916 | A | 3/1969 | Reichert |
| 3,477,506 | A | 11/1969 | Malone |
| 3,667,543 | A | 6/1972 | Dean |
| 3,669,190 | A | 6/1972 | Sizer et al. |
| 3,722,588 | A | 3/1973 | Tamplen |
| 3,776,307 | A | 12/1973 | Young |
| 3,997,193 | A | 12/1976 | Tsuda et al. |
| 4,006,619 | A | 2/1977 | Anderson |
| 4,067,386 | A | 1/1978 | Weise |
| 4,068,372 | A | 1/1978 | Kamohara et al. |
| 4,069,573 | A | 1/1978 | Rogers, Jr. et al. |
| 4,193,105 | A | 3/1980 | Graafmann |
| 4,349,204 | A | 9/1982 | Malone |
| 4,387,507 | A | 6/1983 | Kelly |
| 4,388,752 | A | 6/1983 | Vinciguerra et al. |
| 4,418,457 | A | 12/1983 | Mueller |
| 4,422,317 | A | 12/1983 | Mueller |
| 4,567,631 | A | 2/1986 | Kelly |
| 4,581,817 | A | 4/1986 | Kelly |
| 4,724,693 | A | 2/1988 | Tedder |
| 4,923,007 | A | 5/1990 | Sanford et al. |
| 4,976,322 | A | 12/1990 | Abdrakhmanov et al. |
| 5,052,483 | A | 10/1991 | Hudson |
| 5,337,823 | A | 8/1994 | Nobileau |
| 5,667,252 | A | 9/1997 | Schafer et al. |
| 5,794,702 | A | 8/1998 | Nobileau |
| 5,923,007 | A | 7/1999 | Emmert |
| 6,123,148 | A | 9/2000 | Oneal |
| 6,135,208 | A | 10/2000 | Gana et al. |
| 6,138,761 | A | 10/2000 | Freeman et al. |
| 6,325,148 | B1 | 12/2001 | Trahan et al. |
| 6,409,226 | B1 | 6/2002 | Slack et al. |
| 6,691,786 | B2 | 2/2004 | Patel |
| 6,691,789 | B2 | 2/2004 | Jackson et al. |
| 6,712,151 | B2 | 3/2004 | Simpson et al. |
| 6,742,598 | B2 | 6/2004 | Whitelaw et al. |
| 6,789,622 | B1 | 9/2004 | Ducasse et al. |
| 6,860,329 | B1 | 3/2005 | Oosterling |
| 6,964,305 | B2 | 11/2005 | McMahan et al. |
| 7,017,669 | B2 | 3/2006 | Johnston et al. |
| 7,017,670 | B2 | 3/2006 | Hazel et al. |
| 7,073,583 | B2 | 7/2006 | Anderton et al. |
| 7,152,679 | B2 | 12/2006 | Simpson |
| 7,168,497 | B2 | 1/2007 | Metcalfe et al. |
| 7,228,896 | B2 | 6/2007 | Gazewood |
| 7,350,584 | B2 | 4/2008 | Simpson et al. |
| 7,350,585 | B2 | 4/2008 | Simpson et al. |
| 7,360,591 | B2 | 4/2008 | Ring |
| 7,360,592 | B2 | 4/2008 | McMahan |
| 7,493,945 | B2 | 2/2009 | Doane et al. |
| 7,578,354 | B2 | 8/2009 | Thomson |
| 7,699,115 | B2 | 4/2010 | Baaijens et al. |
| 7,779,924 | B2 | 8/2010 | Clamens |
| 7,828,068 | B2 | 11/2010 | Gano et al. |
| 2002/0092654 | A1 | 7/2002 | Coronado et al. |
| 2002/0195256 | A1 | 12/2002 | Metcalfe et al. |
| 2003/0042022 | A1 | 3/2003 | Lauritzen et al. |
| 2003/0116328 | A1 | 6/2003 | Doane et al. |
| 2004/0074640 | A1 | 4/2004 | Anderton et al. |
| 2004/0112609 | A1 | 6/2004 | Whanger et al. |
| 2004/0216894 | A1 | 11/2004 | Maguire |
| 2004/0226723 | A1 | 11/2004 | Simpson |
| 2004/0244994 | A1 | 12/2004 | Jackson et al. |
| 2005/0000697 | A1 | 1/2005 | Abercrombie Simpson et al. |
| 2005/0023003 | A1 | 2/2005 | Echols et al. |
| 2005/0057005 | A1 | 3/2005 | Simpson et al. |
| 2005/0077052 | A1 | 4/2005 | Ohmer |
| 2005/0127673 | A1 | 6/2005 | Simpson et al. |
| 2005/0217865 | A1 | 10/2005 | Ring |
| 2006/0016597 | A1 | 1/2006 | Emerson |
| 2006/0042801 | A1 | 3/2006 | Hackworth et al. |
| 2006/0090903 | A1 | 5/2006 | Gana et al. |
| 2006/0266530 | A1 | 11/2006 | Echols |
| 2006/0283607 | A1 | 12/2006 | Duggan et al. |
| 2007/0000664 | A1 | 1/2007 | Ring et al. |
| 2007/0205002 | A1 | 9/2007 | Baaijens et al. |
| 2008/0000646 | A1 | 1/2008 | Thomson |
| 2008/0142219 | A1 | 6/2008 | Steele et al. |
| 2008/0236230 | A1 | 10/2008 | Brisco et al. |
| 2009/0205843 | A1 | 8/2009 | Gandikota et al. |

OTHER PUBLICATIONS

Canadian Office Action dated Oct. 1, 2013, in Canadian Application No. 2,821,318.

Dictionary definition of "Poisson's ratio", accessed Oct. 17, 2014 via thefreedictionary.com.

Dictionary definitions of "undulation", accessed Aug. 5, 2011 via www.thefreedictionary.com.

"Poisson's ratio for some common materials", accessed Oct. 17, 2014 via engineeringtoolbox.com.

Supplementary European Search Report dated Apr. 18, 2012, EPO Application No. 09711591.9.

PCT Search Report, International Application No. PCT/US2009/034564, dated Apr. 21, 2009.

EXPANDABLE PACKER

CROSS-REFERENCE TO RELATED APPLICATIONS

This application is a continuation of pending U.S. patent application Ser. No. 13/942,456, filed Jul. 15, 2013, which is a continuation of U.S. patent application Ser. No. 13/523,656, filed Jun. 14, 2012, now U.S. Pat. No. 8,499,844, which is a continuation of U.S. patent application Ser. No. 12/389,090, filed Feb. 19, 2009, now U.S. Pat. No. 8,201,636, which claims benefit of U.S. provisional patent application Ser. No. 61/029,634, filed Feb. 19, 2008. Each of the aforementioned related patent applications is herein incorporated by reference.

BACKGROUND OF THE INVENTION

Field of the Invention

Embodiments of the invention generally relate to expandable tubing assemblies and expanding such assemblies to seal a surrounding annulus.

Description of the Related Art

Drilling a bore into the earth enables access to hydrocarbons in subsurface formations. The process of drilling a borehole and of subsequently completing the borehole in order to form a wellbore requires the use of various tubular strings. Methods and apparatus utilized in the oil and gas industry enable placing tubular strings in a borehole and then expanding the circumference of the strings in order increase a fluid path through the tubing and in some cases to line the walls of the borehole. Some of the advantages of expanding tubing in a borehole include relative ease and lower expense of handling smaller diameter tubing and ability to mitigate or eliminate formation of a restriction caused by the tubing.

Many applications require creating a seal around one of the tubular strings in the wellbore such that fluid flow through a surrounding annulus is blocked. Various types of conventional packers exist that may be set for this purpose without expanding an inside diameter of the tubing. Further, expandable tubing may include a band of elastomeric material disposed on its outer surface to facilitate sealing. However, these bands produce sealing that is localized only at the band and often unreliable due to too low of a seal pressure being achieved.

Therefore, there exists a need for apparatus and methods that enable improved sealing around tubing that has been expanded.

SUMMARY OF THE INVENTION

Embodiments of the invention generally relate to expansion of tubing to create a seal in an annulus surrounding the tubing. A method in one embodiment expands a packer assembly that includes tubing with a sealing element disposed on an outside surface thereof. The sealing element defines thick bands alternating with thin bands that protrude from the outside surface of the tubing less than the thick bands. The method includes expanding the tubing such that relatively greater expansion occurs at where the thin bands are located compared to where the thick bands are located.

A method of expanding a packer assembly for one embodiment includes running tubing with a sealing element disposed on an outside surface thereof into a wellbore. The method includes placing the sealing element into engagement with a surrounding surface. Further, creating undulations in a diameter of the tubing occurs based on alternating first and second properties of the sealing element along a length of the tubing.

An expandable packer assembly according to one embodiment includes tubing having unexpanded and expanded positions. A sealing element disposed on an outside of the tubing defines thick bands alternating along a length of the tubing with thin bands that protrude from the outside of the tubing less than the thick bands. An inner diameter of the tubing along the length is uniform in the unexpanded position and undulations in the inner diameter are at the thin bands in the expanded position.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the invention generally relate to expansion of tubing to create a seal in an annulus surrounding the tubing. The tubing includes a sealing material selected to cause forming of undulations in a diameter of the tubing upon expansion of the tubing. The tubing with the sealing material provides improved sealing performance.

Figure 1:
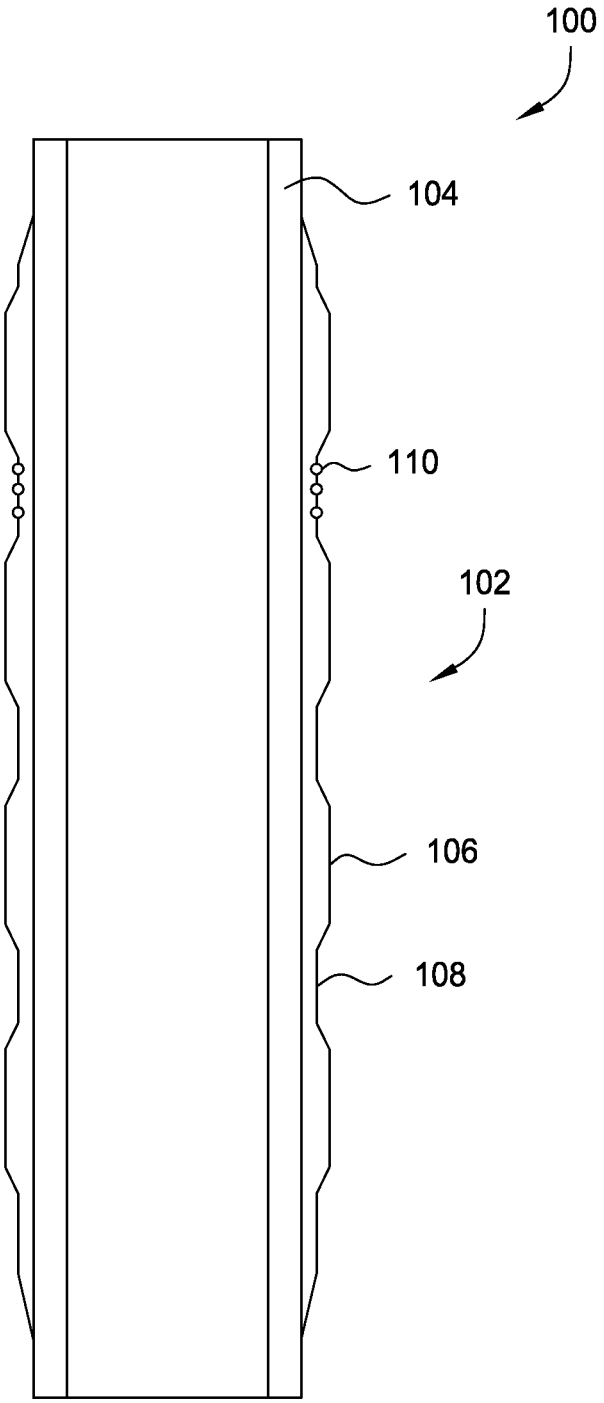
FIG. 1 is a cross-section view of an expandable packer in a pre-expansion run-in position with a profiled sealing material disposed around base tubing.

FIG. 1 illustrates an exemplary expandable packer 100 in a pre-expansion run-in position with a profiled sealing material 102 disposed on an outside of base tubing 104. The sealing material 102 may include an elastomeric material wrapped/molded/positioned around the tubing 104 continuous along a length of the tubing 104 that may include all or part of the tubing 104. Along this length of the tubing 104 where the sealing material 102 extends, a property (e.g., thickness, compressibility, hardness or swelling extent) of the sealing material 102 varies to achieve post expansion results as described further herein. Consistency of the profiled sealing material 102 can use hard, soft or swellable elastomeric material or a combination thereof to achieve desired high pressure sealing for cased hole or open-hole conditions. In some embodiments, the variation of the sealing material 102 occurs along a section of the tubing 104 at least in part due to discontinuity of the sealing material 102. For example, a longitudinal break in the sealing material 102 may leave the tubing 104 without the sealing material 102 at the break.

By way of example since thickness is suitable for illustration, the profiled sealing material 102 defines a topography that alternates lengthwise over the tubing 104 between thick bands 106 of the sealing material 102 that occupy a greater annular area than thin bands 108 of the sealing material 102. Each of the bands 106, 108 circumscribe the tubing 104 to form a ring shape oriented transverse to a longitudinal bore of the tubing 104. The expandable packer 100 may utilize any number of the bands 106, 108 and in some embodiments has at least one of the thick bands 106 disposed between two of the thin bands 108.

Machining of the sealing material 102 from an initially uniform thickness may create differences in the thickness of the bands 106, 108. Further, separate additional outer sleeves may add to thickness of the sealing material 102 at the thick bands 106. Tailored molding of the sealing material 102 offers another exemplary approach to provide the differences in the thickness between the bands 106, 108 of the sealing material 102.

For some embodiments, a gripping structure or material may be located on the outside of the tubing 104 such that when the tubing 104 is expanded the gripping structure or material moves outward in a radial direction and engages a surrounding surface (e.g., casing or open borehole) to facilitate in anchoring the tubing 104 in place. As an example, the expandable packer 100 includes a grit 110 disposed on the outside of the tubing 104. The grit 110 such as tungsten carbide or silicon carbide may adhere to any portion of the tubing 104 that is to be expanded. In some embodiments, the sealing material 102 at one or more of the thin bands 108 include the grit 110 that is coated on or embedded therein.

Figure 2:
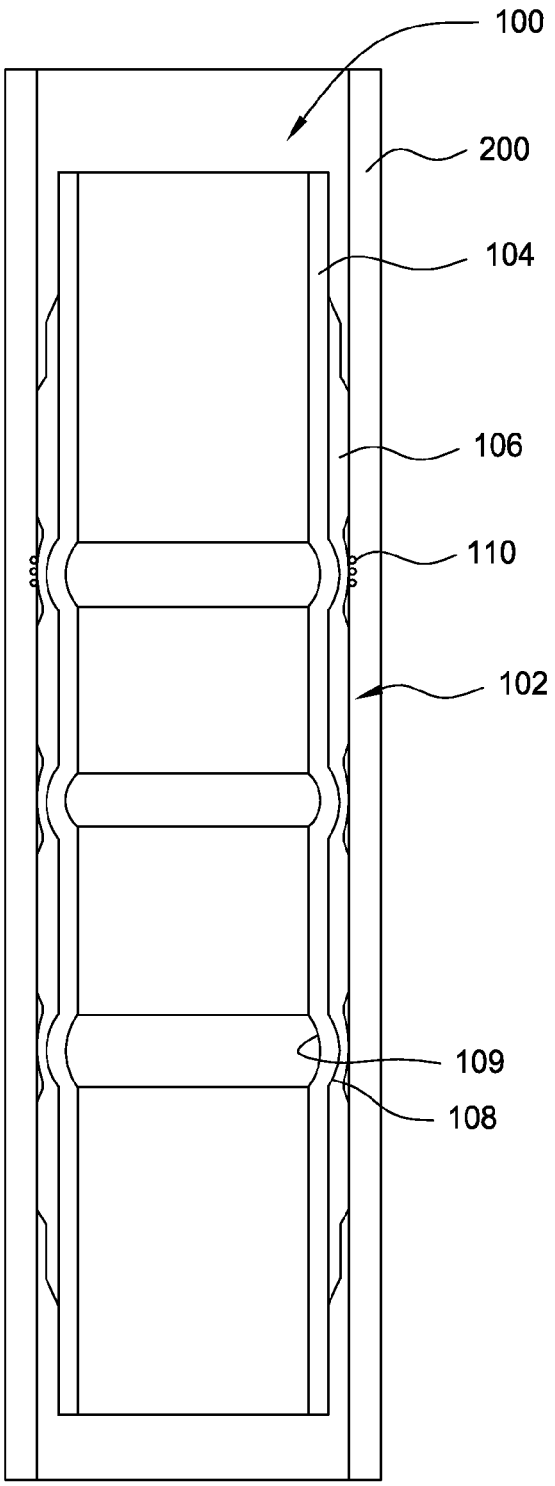
FIG. 2 is a cross-section view of the expandable packer in an expanded position within a surrounding structure such as casing.

FIG. 2 shows the expandable packer 100 in an expanded position within a surrounding structure such as an open borehole or casing 200. Upon expansion, the tubing 104 plastically deforms selectively creating undulations 109 resulting in high pressure sealing. The grit 110, if present, also embeds in the casing 200 upon expansion to aid in hanging the expandable packer 100. The undulations 109 occur as a result of and where the thin bands 108 of the sealing material 102 permit relatively greater radial expansion of the tubing 104. While not expanded as much, the tubing 104 corresponding to where the thick bands 106 of the sealing material 102 are located also deforms in a radial outward direction to place the thick bands 106 into engagement with the casing 200. Design of the sealing material 102 thus creates a specific pattern of the undulations 109 after expansion.

Expansion of the tubing 104 may occur utilizing an inflatable expander having a flexible bladder that is pressurized into contact with the inside of the tubing 104. For some embodiments, a compliant (i.e., not a fixed diameter during expansion) cone or a compliant rotary expander tool can achieve expansion of the tubing 104. Further, hydroforming techniques using only fluid pressure to act directly against an inside surface of the tubing 104 may expand the tubing 104. Such hydroforming of the tubing 104 employs seals spaced apart inside the tubing 104 such that hydraulic pressure may be applied to an interior volume of the tubing 104 between the seals.

One potential cause for loss of sealing occurs if the fluid pressure in the annulus between the tubing 104 and wellbore causes the tubing 104 to collapse, thereby pulling the sealing element 102 away from its sealing engagement with the casing 200. The undulations 109 tend to increase collapse resistance of the tubing 104 compared to tubing which has been expanded to have a constant diameter. Thus, the increase in collapse resistance benefits sealing ability of the sealing element 102. Further, the undulations 109 at least reduce any potential decreases in seal load as a result of elastic recovery of the tubing 104 immediately after expansion. The undulations 109 may experience less elastic recovery than when a longer length of the tubing 104 is expanded, thereby mitigating effect of the elastic recovery causing removal of the seal load. While it is believed that these mechanisms enhance sealing performance as determined by test data results described herein, other factors without limitation to any particular theory may alone or in combination cause the improvements in the sealing performance obtained.

Figure 3:
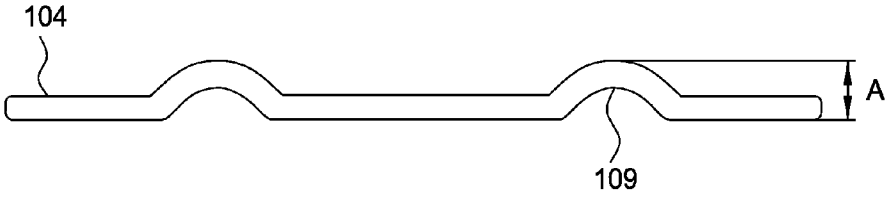
FIG. 3 is a schematic illustration showing amplitude of undulations created in the base tubing upon expanding as a result of the profiled sealing material.

FIG. 3 schematically illustrates amplitude (A) of the undulations 109 created in the tubing 104 upon expanding. In particular, the amplitude as identified represents extent of localized radial deformation defined as difference between an inner diameter of the tubing 104 adjacent the undulation 109 and an outer diameter of the tubing 104 at a peak of the undulation 109. The undulations 109 created in part due to the profiled sealing material 102 influence sealing performance of the expandable packer 100.

Figure 4:
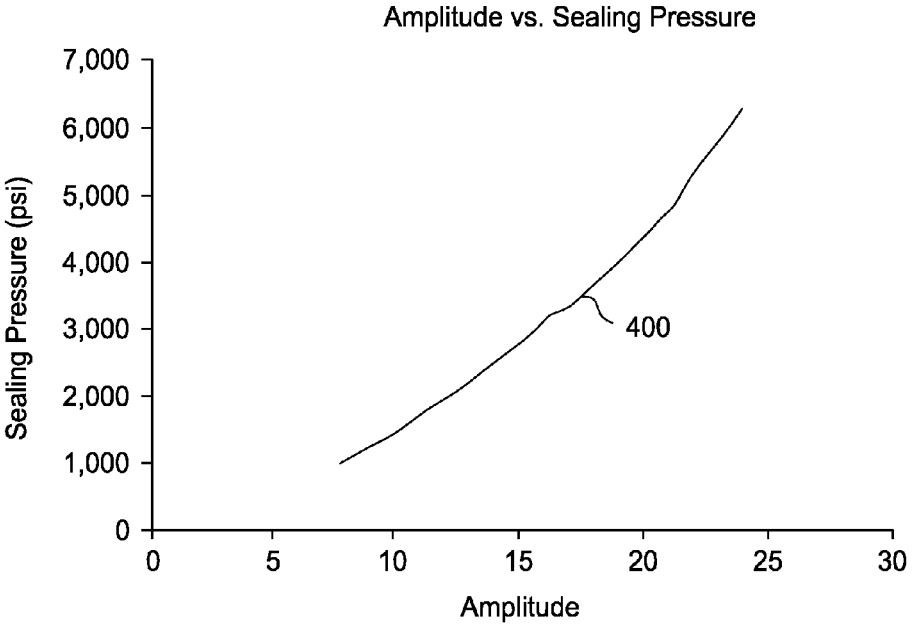
FIG. 4 is a graph depicting sealing pressure performance as a function of the amplitude.

FIG. 4 in particular shows a graph depicting sealing pressure performance as a function of the amplitude characterized as a generic unit length. The sealing pressure performance for this amplitude based analysis occurs as a result of discrete localized sealing engagement at only the undulations 109 without sealing engagement extending over a substantial length of the tubing 104. The results shown demonstrate that sealing pressure achievable trends higher along an amplitude curve 400 with increase in the amplitude. Selection of the amplitude can alter sealing pressure achievable by several multiples. It is to be noted that this illustrates one embodiment of a sealing arrangement where the undulations 109 are formed and only the thin bands 108 contact and create a seal with the surrounding structure. In another embodiment, upon expansion, the undulations 109 are formed but only the thick bands 106 contact and create a seal with the surrounding structure. In a further embodiment, upon expansion, the undulations 109 are formed and the thin bands 108 contact the surrounding structure while only the thick bands 106 create a seal with the surrounding structure. In yet a further embodiment, upon expansion, the undulations 109 are formed whereby both the thin bands 108 and the thick bands 106 contact and create a seal with the surrounding structure.

Several design factors of the sealing element 102 influence generation of the undulations 109 and resulting seal created by the expandable packer 100. Factors that can influence the amplitude achieved and enable creation of the amplitude that is sufficiently high to provide the seal performance desired include a thickness deviation ratio between the thick and thin bands 106, 108 of the sealing element 102, a pitch of the sealing element 102 as defined by distance between the thick bands 106, the number of undulations 109, the number of bands 106, 108 and the material and dimensional properties of the tubing 104, such as yield strength, ductility, wall thickness and diameter. These design factors in combination with the radial expansion force applied by the expander tool control the amplitude of the undulation 109.

Figure 5:
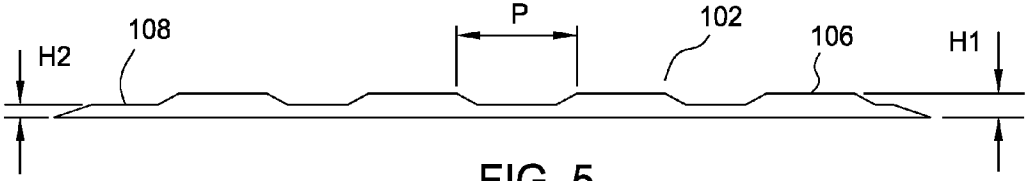
FIG. 5 is a schematic illustration showing a thickness deviation ratio and pitch defined by topography of the profiled sealing material.

FIG. 5 illustrates a max height (H1) of the thick band 106 protruding from the tubing 104 and an intermediate height (H2) determined by protrusion of the thin band 108. The thickness deviation ratio equals H1/H2. The pitch (P) as shown represents longitudinal distance between the max heights of two consecutive ones of the thick bands 106. The pitch and the thickness deviation ratio play an important role for high pressure sealing through radial expansion of the packer assembly 100.

Figure 6:
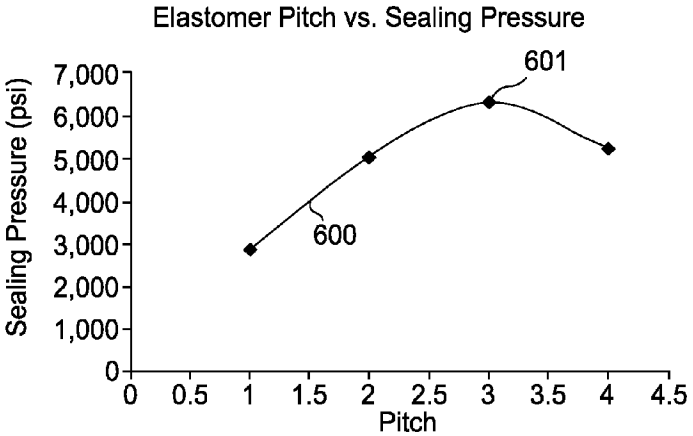
FIG. 6 is a graph depicting sealing pressure performance as a function of the pitch.

FIG. 6 shows a graph depicting sealing pressure performance as a function of the pitch characterized as a generic unit length. The dimension of the pitch in combination with the physical and dimensional parameters of the material has an effect on the curvature of the undulations 109 being formed. For a given material and a given set of dimensions a shorter pitch results in a less undulation and a longer pitch results in a greater undulation. By varying the parameters, the curvature of undulation is altered. Shorter pitch results in lower sealing pressure as sufficient values for the amplitude cannot be generated during expansion. Further, broadening out of the undulation 109 along the tubing 104 as occurs when the pitch increases beyond that required to achieve the amplitude desired can decrease sealing pressure. A pitch curve 600 demonstrates that the sealing pressure increases with increase in the pitch up to a threshold for the pitch at which point further increase in the pitch reduces the sealing pressure. For any given application with specific criteria such as pre-expansion diameter and wall thickness of the tubing 104, analytical/empirical models may enable selection of the pitch to achieve a maximum seal performance as identified by point 601 along the pitch curve 600.

Figure 7:
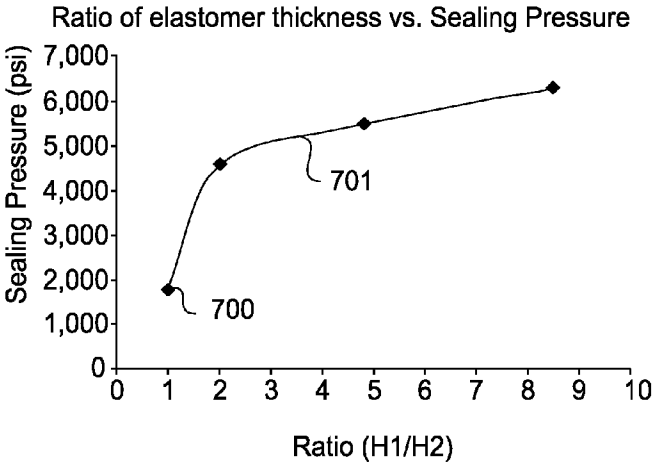
FIG. 7 is a graph depicting sealing pressure performance as a function of the thickness deviation ratio.

FIG. 7 illustrates a graph depicting sealing pressure performance as a function of the thickness deviation ratio. The seal pressure performance improves when the ratio increases (i.e., increasing the maximum height of the thick bands 106 of the sealing element 102 and/or decreasing the intermediate height provided by the thin bands 108 of the sealing element 102). As the thickness deviation ratio increases from one to two to provide the thick band 106 protruding twice as far as the thin band 108, the sealing pressure achievable increases along a ratio curve 701 by a factor greater than two. Further increases in the thickness deviation ratio result in slower continued increase in the sealing pressure. For some embodiments, the ratio is selected to be between 1.25 and 5.0, between 1.5 and 2.5, or between 1.75 and 2.25.

As a comparative example, point 700 on the ratio curve 701 corresponds to prior sealing elements having a uniform thickness across a length that is expanded into sealing engagement such that no undulations exist. Such prior sealing elements can, based on location of the point 700, only maintain sealing at pressures below about 1800 pounds per square inch (psi) (12,410 kilopascal (kPa)).

Figure 8:
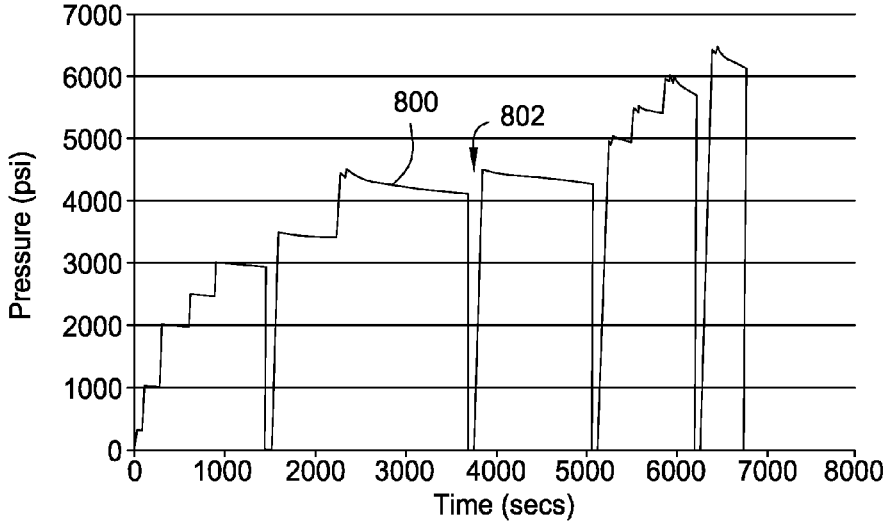
FIGS. 8 and 9 are plots of data from seal pressure tests of the expandable packer at about 22° C. and 100° C., respectively.
Figure 9:
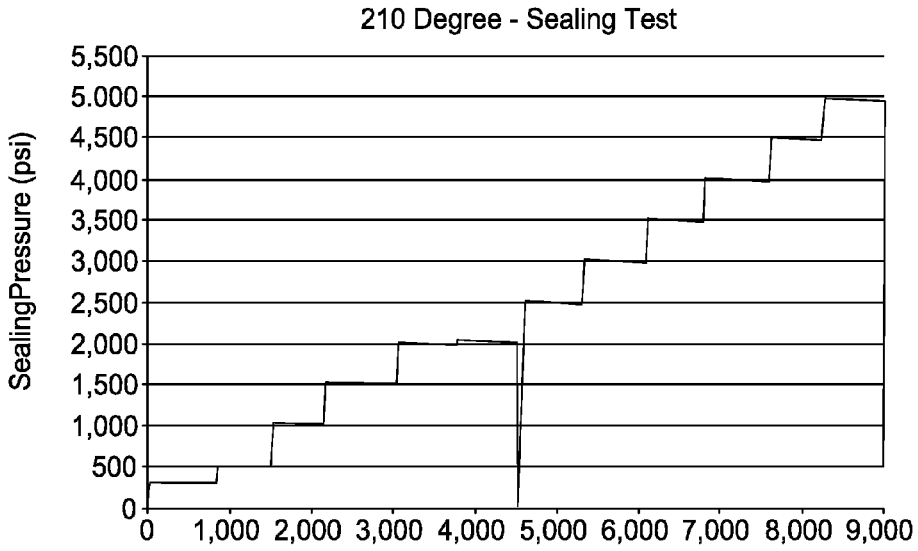

FIGS. 8 and 9 show plots of data from seal pressure tests of the expandable packer 100 at about 22° C. and 100° C., respectively. The expandable packer 100 was tested up to 6500 psi (44,815 kPa) without sealing failure which illustrates the ability to select attributes to create undulations as set forth herein to obtain a much higher seal pressure as compared to prior sealing elements which by comparison would only maintain pressures of about 1800 psi. Downward trending 800 occurs over time once each of the pressures tested is initially reached as a result of equilibration as the sealing material 102 further compresses. In addition, drop offs 802 at certain times in the plots occur due to intentional pressure relief prior to further pressurization and not any failure of the sealing by the expandable packer 100.

Figure 10:
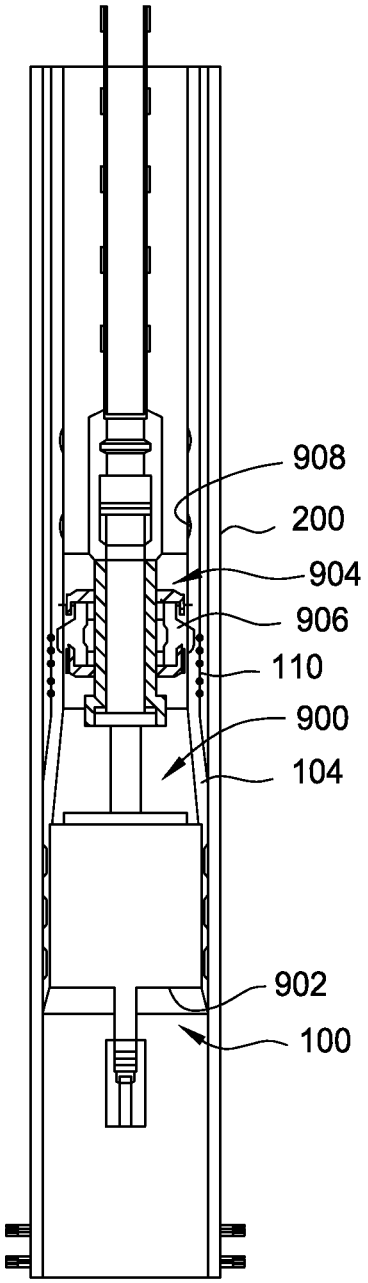
FIG. 10 is a cross section view of the expandable packer during an expansion operation with an exemplary expander tool such as an inflatable device with a locating mechanism.

FIG. 10 illustrates the expandable packer 100 during an expansion operation with an exemplary expander tool 900 such as an inflatable device having a bladder 902 that is capable of being fluid pressurized to expand the tubing 104. For some embodiments, the expander tool 900 includes a locating mechanism 904. The locating mechanism 904 includes dogs 906 biased outward to engage recesses 908 at selected locations along an inside of the tubing 104. Mechanical engagement between the dogs 906 and each of the recesses 908 provides resistance from further relative movement of the expander tool 900 within the tubing 104. Other mechanical devices such slips or other forms of retractable grippers may be used in place of the dogs 906.

The selected locations thus identify when the expander tool 900 has been located where desired such as when moving the expander tool 900 from its position at a last expansion cycle to a subsequent length of the tubing 104 for expansion. Use of the locating mechanism 904 helps ensure that a length of the tubing 104 is not missed in the expansion process. Any missed sections may have trapped fluid that inhibits expansion of the missed sections. Attempts to later expand missed sections may force such trapped fluid to collapse surrounding sections of the tubing 104 previously expanded.

In operation, expansion of the expandable packer 100 does not require expensive high pressure pumps on a rig as a mobile pump using relatively less volume can operate the expander tool 900. The expander tool 900 also works reliably over multiple expansion cycles especially given that expansion ratios may be controlled to be less than 50%.

Figure 11A:
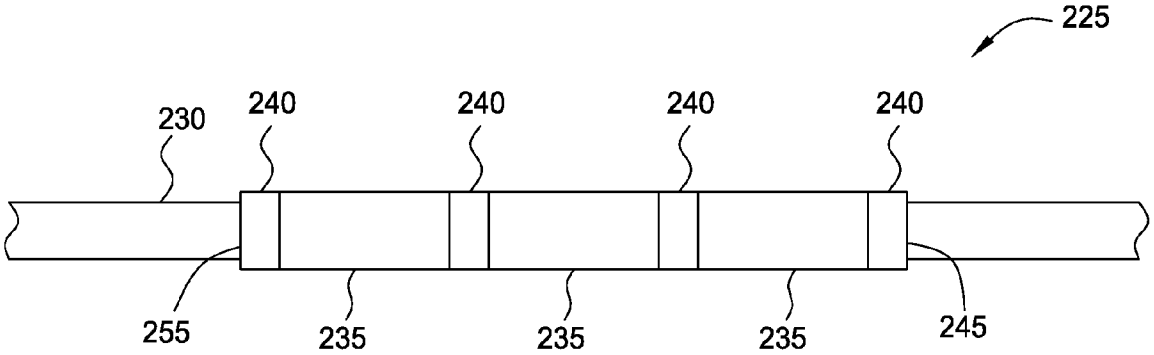
FIGS. 11A and 11B are views illustrating an expansion tool for use with the expandable packer.
Figure 11B:
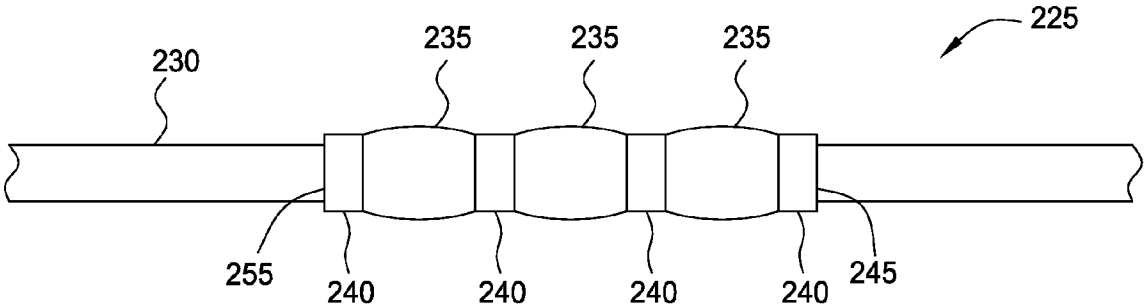

FIGS. 11A and 11B are views illustrating an expansion tool 225 for use with the expandable packer 100. The expansion tool 225 includes a mandrel 230, elastomeric sections 235 and optional spacer bands 240. Generally, the expansion tool 225 is actuated by applying an axial force to elastomeric sections 235 by a force member, such as a hydraulic jack, which causes the elastomeric sections 235 to compress and expand radially outward, as shown in FIG. 11B. In turn, the outward expansion of the elastomeric sections 235 causes a surrounding tubular to expand radially outward. It is to be noted that the bands 240 may also expand radially outward but not as much as the elastomeric sections 235. In one embodiment, a first end 245 of the expansion tool 225 is movable and a second end 255 is fixed. In this embodiment, the force is applied to the first end 245 which causes the first end 245 to move toward the second end 255, thereby compressing the elastomeric sections 235. In another embodiment, the first end 245 and the second end 255 are movable and the forces are applied to both ends 245, 255 to compress the elastomeric sections 235. In a further embodiment, the second end 255 is fixed to the mandrel 230 and the first end 245 is movable. In this embodiment, the force is applied to the first end 245 while substantially simultaneously pulling on the mandrel 230 to move the second end 255 toward the first end 245, thereby compressing the elastomeric sections 235.

The elastomeric sections 235 may be made from rubber or any other type of resilient material. The elastomeric sections 235 may be coated with a non-friction material (not shown) such as a composite material. The non-friction material is used to reduce the friction between the elastomeric sections 235 and the surrounding tubular. Further, the non-friction material may protect the elastomeric sections 235 from damage or wear which may occur due to multiple expansion operations.

The bands 240 in between the elastomeric sections 235 are used to separate elastomeric sections 235. The bands 240 may be made from any suitable material, such as thin metal, composite material or elastomeric material having a hardness that is different from the elastomeric sections 235.

Figure 12A:
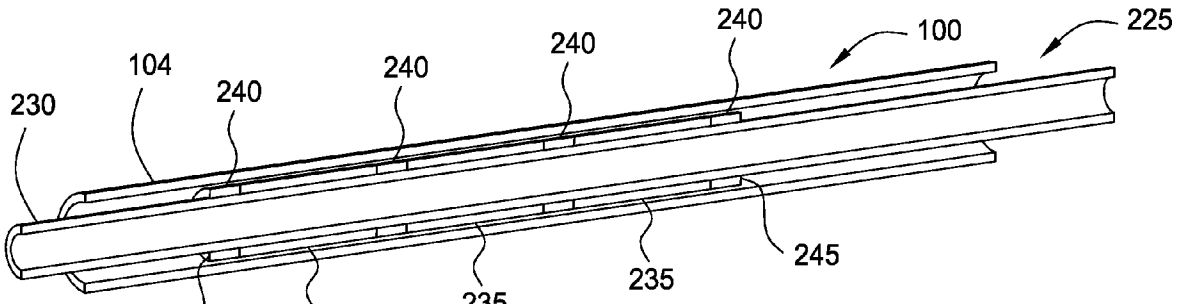
FIGS. 12A and 12B are views illustrating the expansion tool disposed in the expandable packer.
Figure 12B:
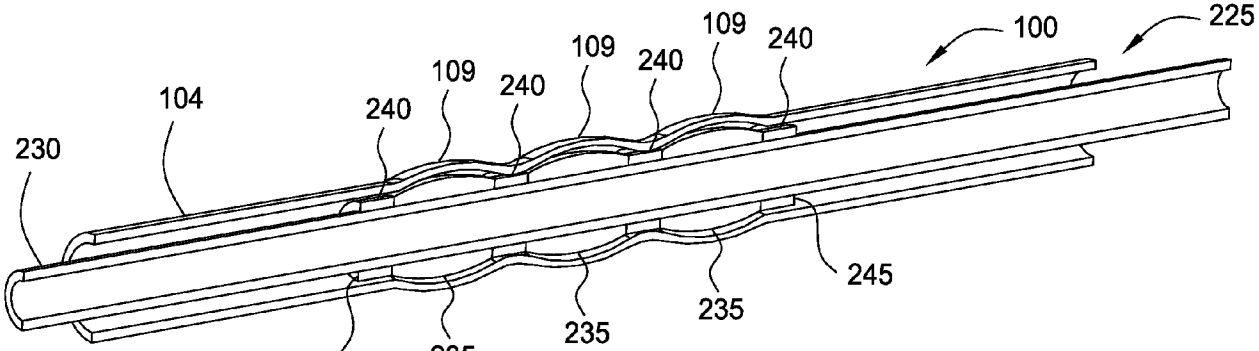

FIGS. 12A and 12B are views illustrating the expansion tool 225 disposed in the tubing 104 of the expandable packer 100. For clarity, the thick bands 106 and the thin bands 108 of the sealing material 102 are not shown. The expansion tool 225 may be used to expand the expandable packer 100 into an expanded position within a surrounding structure such as an open borehole or casing (not shown). Upon expansion, the tubing 104 is plastically deformed to selectively create the undulations 109 which result in a high pressure seal, as shown in FIG. 12B. The expansion tool 225 may be located in the expandable packer 100 in any manner. In one embodiment, the expansion tool 225 is located in the expandable packer 100 such that the elastomeric sections 235 are positioned adjacent the thin bands 108 and the bands 240 are positioned adjacent the thick bands 106. Upon activation of the expansion tool 225, the elastomeric sections 235 expand radially outward which causes the tubular 104 to plastically deform and form the undulations 109. While not expanded as much, the tubing 104 corresponding to where the thick bands 106 of the sealing material 102 are located also deforms in a radial outward direction to place the thick bands 106 into engagement with the casing. It is to be noted that the undulations 109 tend to increase collapse resistance of the tubing 104. Thus, the increase in collapse resistance benefits the sealing ability of the sealing element 102. Further, the undulations 109 at least reduce any potential decreases in seal load as a result of elastic recovery of the tubing 104 immediately after expansion. The undulations 109 may also experience less elastic recovery than when a longer length of the tubing 104 is expanded, thereby mitigating effect of the elastic recovery causing removal of the seal load.

Figure 13A:
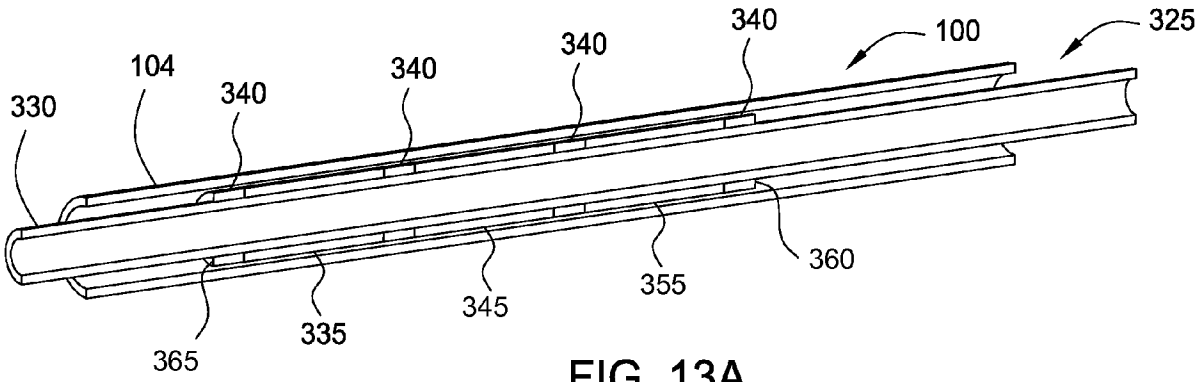
FIGS. 13A and 13B are views illustrating an expansion tool disposed in the expandable packer.
Figure 13B:
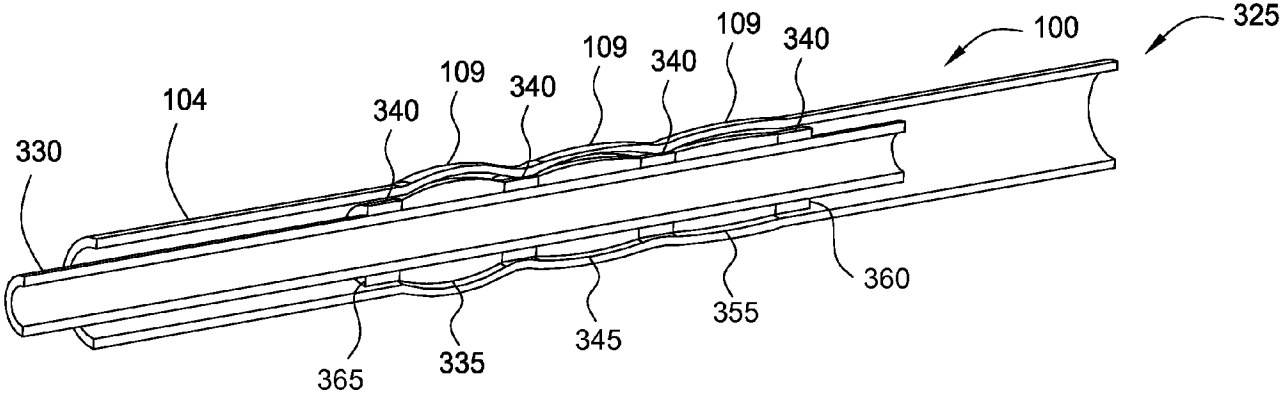

FIGS. 13A and 13B are views illustrating an expansion tool 325 disposed in the tubing 104 of the expandable packer 100. The expansion tool 325 includes a mandrel 330, elastomeric sections 335, 345, 355 and optional bands 340. The expansion tool 325 operates by applying an axial force to elastomeric sections 335, 345, 355 which causes the elastomeric sections 335, 345, 355 to compress and expand radially outward.

The expansion tool 325 may be used to expand the expandable packer 100 into an expanded position within a surrounding structure such as an open borehole or casing (not shown). For clarity, the thick bands 106 and the thin bands 108 of the sealing material 102 are not shown. As illustrated, the elastomeric sections 335, 345, 355 are tapered down (or tiered) from one end 355 to another end 345. The reducing diameter of the elastomeric sections 335, 345, 355 may be stepwise (as illustrated), or it may be a continuous reducing diameter, such as cone shaped. The taper in the elastomeric sections 335, 345, 355 may be used to drive fluid out of the annulus between the casing and the sealing material on the expandable packer 100, thereby preventing any pipe collapse due to trapped fluid expansion. The bands 340 between the elastomeric sections 335, 345, 355 are not tapered. However, in one embodiment, the bands 340 may have a taper in a similar manner as the elastomeric sections 335, 345, 355.

FIG. 13B illustrates the expansion tool 325 inside the tubing 104 during the expansion process. The first portion of the tubing 104 that is juxtaposed with the thicker elastomeric section 335 expands first and additional axial force is applied to expand the elastomeric sections 345, 355 to subsequently expand the remaining portions of the tubular 104 similar to the first portion. In other words, the expansion process along the short length of the tubular 104 is progressive. As shown, the tubing 104 is plastically deformed to selectively create the undulations 109 which result in a high pressure seal between the expandable packer 100 and the surrounding structure. It is to be noted that the resulting undulations 109 are also tapered (or tiered) similar to the elastomeric sections 335, 345, 355. The expansion tool 325 may be positioned in the expandable packer 100 in any manner. In one embodiment, the expansion tool 325 is located in the expandable packer 100 such that the elastomeric sections 335, 345, 355 are positioned adjacent the thin bands 108 and the bands 340 are positioned adjacent the thick bands 106.

Figure 14A:
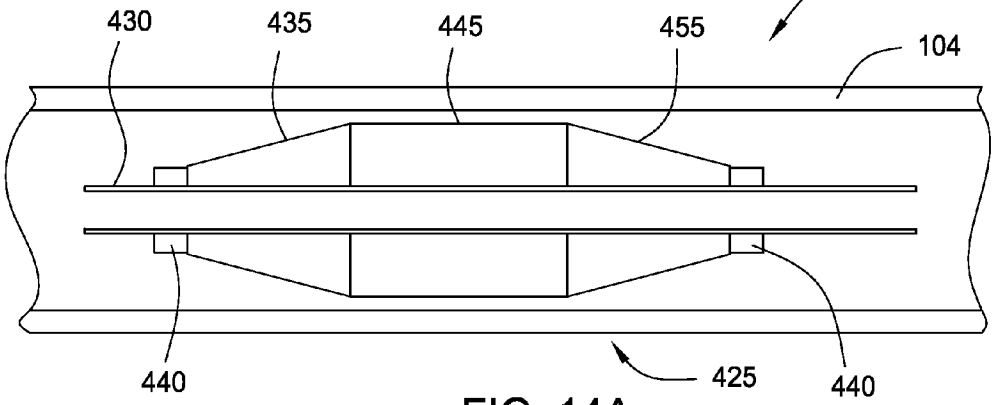
FIGS. 14A and 14B are views illustrating an expansion tool disposed in the expandable packer.
Figure 14B:
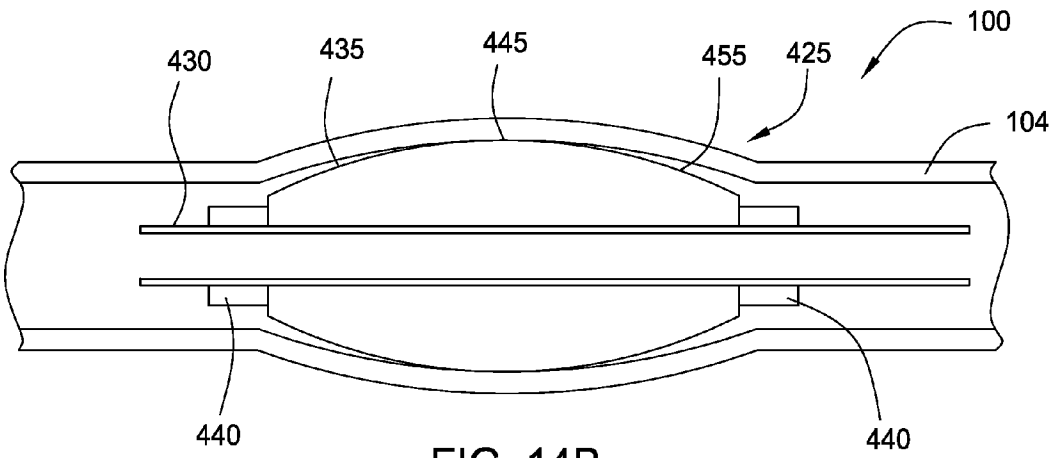

FIGS. 14A and 14B are views illustrating an expansion tool 425 disposed in the tubing 104 of the expandable packer 100. The expansion tool 425 includes a mandrel 430, elastomeric sections 435, 445, 455 and optional bands 440. The expansion tool 425 operates by applying an axial force to elastomeric sections 435, 445, 455 which causes the elastomeric sections 435, 445, 455 to compress and expand radially outward. The expansion tool 425 may be used to expand the expandable packer 100 into an expanded position within a surrounding structure. For clarity, the thick bands 106 and the thin bands 108 of the sealing material 102 are not shown. As illustrated, the elastomeric sections 435 and 455 are tapered down from the elastomeric section 445 to create a profiled shape. The way the tubular expands by utilizing the profiled shape of the elastomeric sections 435, 445, 455 will drive fluid out of the annulus between the casing and the sealing material on the expandable packer 100, thereby preventing trapped fluid expansion in the annulus. As shown in FIG. 14B, the tubing 104 plastically deforms. It is to be noted the undulations may be formed in the tubing 104 in a similar manner as set forth in FIGS. 1 and 2, thereby resulting in a high pressure sealing between the expandable packer 100 and the surrounding structure.

Figure 15A:
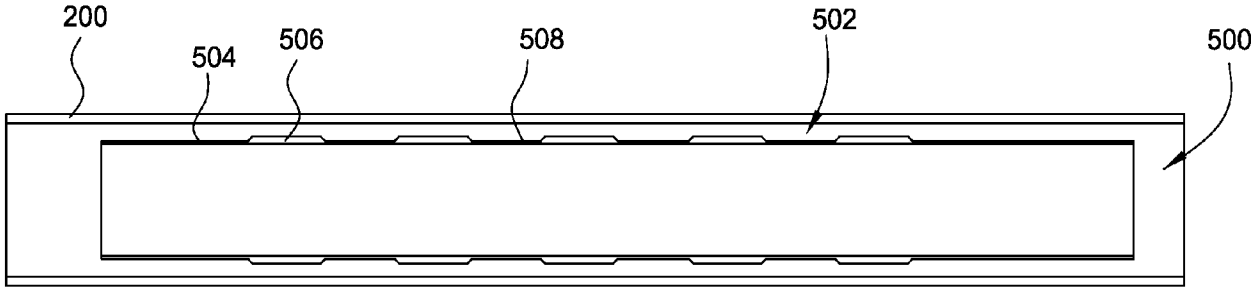
FIGS. 15A and 15B illustrate an expandable packer in a casing.
Figure 15B:
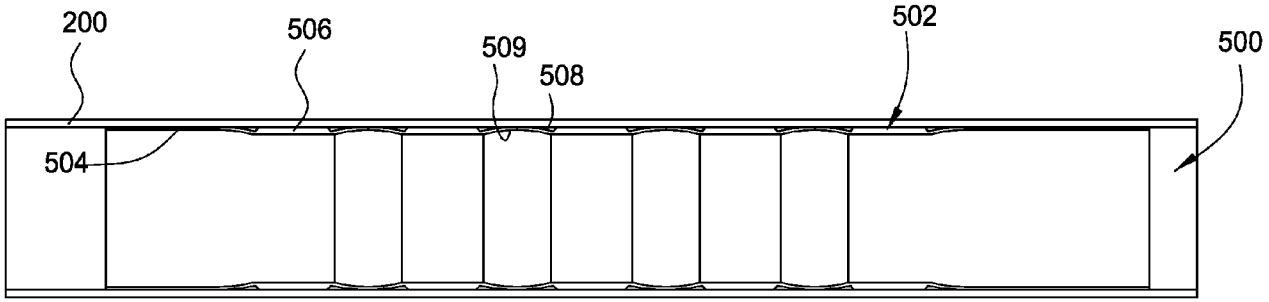
Figure 16A:
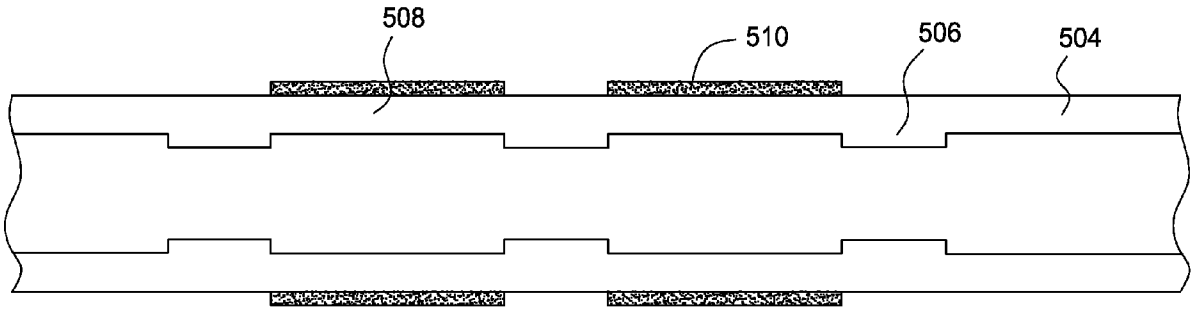
FIGS. 16A and 16B illustrate another embodiment of the expandable packer.
Figure 16B:
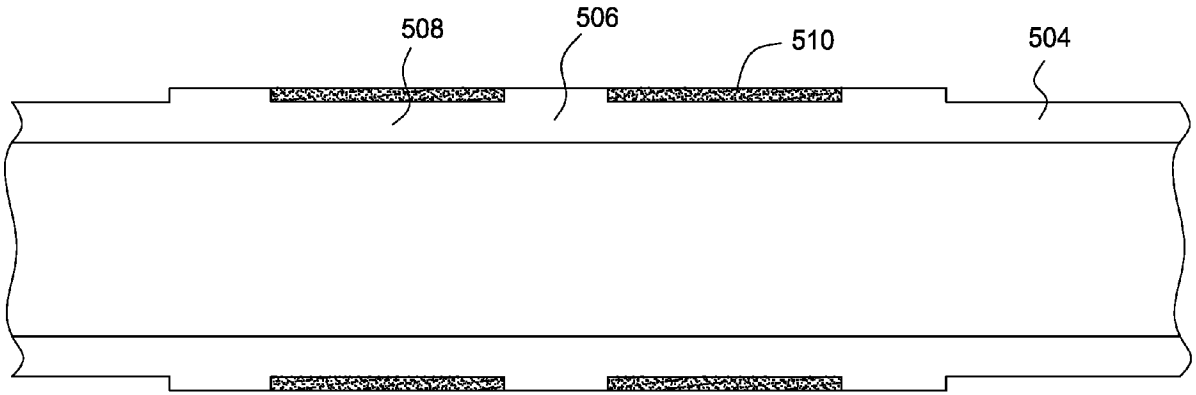
Figure 17A:
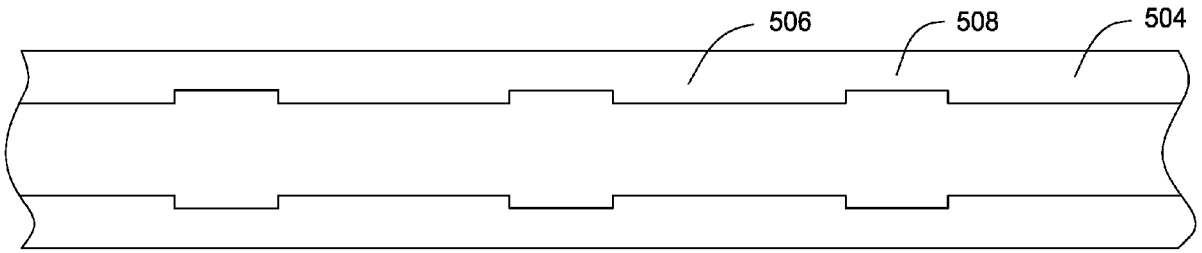
FIGS. 17A and 17B illustrate another embodiment of the expandable packer.
Figure 17B:
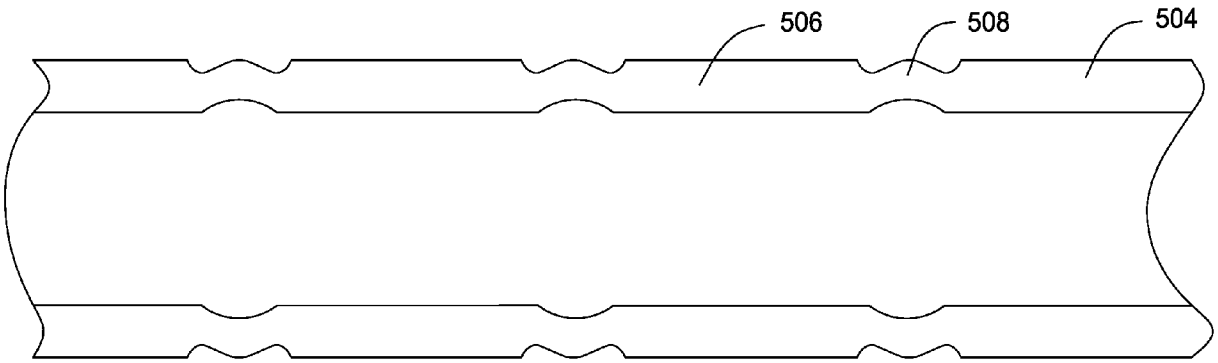

FIGS. 15A and 15B illustrate an expandable packer 500 in the casing 200. The expandable packer 500 includes a profiled sealing material 502 disposed on an outside surface of a base tubing 504. The sealing material 502 may be the same material as the material of the base tubing 504. For instance, a portion of the wall of the base tubing 504 may be cut to form the sealing material 502. The wall of the base tubing 504 may be machined on a portion of the outer diameter and/or a portion of the inner diameter. FIG. 16A illustrates a portion of the inner diameter of the tubing 504 having been machined to form thick bands 506 and thin bands 508. Additionally, optional elastomeric elements 510 may be placed around an outer surface of the tubing 508. FIG. 16B illustrates the tubing 504 shown in FIG. 16A after expansion. FIG. 17A illustrates a portion of the inner diameter of the tubing 504 having been machined to form thick bands 506 and thin bands 508. FIG. 17B illustrates the tubing 504 shown in FIG. 17A after expansion.

Returning back to FIG. 15A, in another embodiment, the sealing material 502 may be different material placed around the tubing 504, such as a soft metal with low yield strength, high malleability and ductility. Along this length of the tubing 504 where the sealing material 502 extends, a property (e.g., thickness, compressibility, or hardness) of the sealing material 502 may vary to achieve desired expansion results. As illustrated, the sealing material 502 defines a topography that alternates lengthwise over the tubing 504 between thick bands 506 of the sealing material 502 that occupy a greater annular area than thin bands 508 of the sealing material 502. Each of the bands 506, 508 circumscribe the tubing 504 to form a ring shape oriented transverse to a longitudinal bore of the tubing 504. The expandable packer 500 may utilize any number of the bands 506, 508 and in some embodiments has at least one of the thick bands 506 disposed between two of the thin bands 508. Additionally, in some embodiments, a grit (not shown) or other grip enhancing formations, such as slips, may be disposed on the outside of the tubing 504, as set forth herein.

FIG. 15B shows the expandable packer 500 in an expanded position within a surrounding structure such as an open borehole or casing 200. Upon expansion, the tubing 504 plastically deforms selectively creating undulations 509 resulting in high pressure sealing. The undulations 509 occur as a result of and where the thin bands 508 of the sealing material 502 permit relatively greater radial expansion of the tubing 504. While not expanded as much, the tubing 504 corresponding to where the thick bands 506 of the sealing material 502 are located also deforms in a radial outward direction to place the thick bands 506 into engagement with the casing 200. In this manner, a metal to metal seal may be generated and retained due to residual plastic strain on the tubing 504. It should be noted that the casing 200 may also be deformed elastically to enhance the metal to metal seals. Further, it should be noted that the undulations 509 tend to increase collapse resistance of the tubing 504 which benefits the sealing ability of the sealing element 502. In another embodiment, the seal between the expandable packer 500 and the casing 200 may be a combination of metal to metal and elastomeric seals.

It is also to be noted that the expansion tools 225, 325, 425 may be used to form the undulations in the expandable packer 100, 500. In addition, the expansion tools 225, 325, 425 may be used to form undulations in other types of tubulars, such as plain pipe with or without sealing elastomers.

For some embodiments, the expandable packer provides a straddle packer, a liner hanger packer, a bridge plug, a scab liner, a zonal isolation unit or a tie back shoe. The expandable packer enables hanging of liners while providing high pressure sealing. The grit or slips of the expandable packer enhance anchoring capability and may be coated on part of the tubing separate from the sealing element. Further, in any embodiment, the sealing material may be a swellable elastomeric material.

In a further embodiment, a force member may be used to place the tubing of the expandable packer in a compressive state prior to expansion of the expandable packer by placing the tubing in axial compression. While the tubing is in the compressive state, the expandable packer may be expanded such that the tubing plastically deforms to selectively create the undulations as set forth herein. An example of axial compression enhanced tubular expansion is described in US Patent Publication No. 2007/0000664, which is herein incorporated by reference.

While the foregoing is directed to embodiments of the present invention, other and further embodiments of the invention may be devised without departing from the basic scope thereof, and the scope thereof is determined by the claims that follow.

The invention claimed is:

1. An expandable packer assembly, comprising:

a tubing having an unexpanded position and an expanded position, wherein an outer diameter of the tubing is uniform in the unexpanded position; and wherein an outer surface of the tubing comprises a sealing portion having a plurality of alternating thick and thin bands formed along a longitudinal length of the tubing, wherein the thick bands have an inner diameter less than an inner diameter of the thin bands when the tubing is in the unexpanded position, and wherein at least one of the thin bands and at least one of the thick bands are configured to engage an outer tubular in the expanded position.

2. The assembly of claim 1, wherein the thick and thin bands are formed by machining a wall of the tubing.

3. The assembly of claim 1, wherein the thin bands are longer than the thick bands.

4. The assembly of claim 1, wherein the sealing portion is continuous along the longitudinal length of the tubing.

5. The assembly of claim 1, wherein the sealing portion is the same material as the tubing.

6. The assembly of claim 1, wherein the sealing portion includes grit that embeds in a surrounding surface in the expanded position.

7. The assembly of claim 1 further comprising a plurality of elastomeric elements disposed on the outer surface of the tubing.

8. The assembly of claim 7, wherein at least one of the plurality of elastomeric elements is disposed on the outer surface of the tubing adjacent to at least one thin band.

9. The assembly of claim 1, wherein each thin band forms a recess along the inner surface of the tubing configured to receive a locating mechanism of an expander tool.

10. A method of expanding a packer assembly, comprising:

positioning a tubing of the assembly in a location to be expanded, wherein an outer diameter of the tubing is uniform in an unexpanded position, wherein an outer surface of the tubing comprises a sealing portion, wherein the tubing comprises a plurality of alternating thick and thin bands formed along a longitudinal length of the tubing, and wherein the thick bands have an inner diameter less than an inner diameter of the thin bands when the tubing is in the unexpanded position; and expanding the tubing into contact with a surrounding surface, wherein at least one of the thin bands and at least one of the thick bands are configured to engage the surrounding surface.

11. The method of claim 10, wherein the thick and thin bands are formed by machining a wall of the tubing.

12. The method of claim 10, wherein the thin bands are longer than the thick bands.

13. The method of claim 10, wherein the sealing portion is continuous along the longitudinal length of the tubing.

14. The method of claim 10, wherein the sealing portion is the same material as the tubing.

15. The method of claim 10, wherein the sealing portion comprises grit that embeds in the surrounding surface in the expanded position.

16. The method of claim 10, wherein the packer assembly further comprises a plurality of elastomeric elements disposed on the outer surface of the tubing.

17. The method of claim 16, wherein at least one of the plurality of elastomeric elements is disposed on the outer surface of the tubing adjacent to at least one thin band.

18. The method of claim 10, wherein each thin band forms a recess along the inner surface of the tubing configured to receive a locating mechanism of an expander tool.

19. The method of claim 18, further comprising moving the expander tool through the tubing until the locating mechanism engages at least one recess.

20. The method of claim 19, wherein the locating mechanism is a plurality of dogs biased radially outward.

* * * * *